US005793268A

United States Patent [19]

Ataiiyan et al.

[11] Patent Number: 5,793,268

[45] Date of Patent: Aug. 11, 1998

[54] MULTI-OCTAVE TUNABLE PERMANENT MAGNET FERRITE RESONATOR

[75] Inventors: Younes J. Ataiiyan, Santa Rosa; Ernest Nyiri, Bodega Bay; Mark Lampenfeld, Santa Rosa, all of Calif.

[73] Assignee: Microsource, Inc., Santa Rosa, Calif.

[21] Appl. No.: 835,949

[22] Filed: Apr. 14, 1997

[51] Int. Cl.[6] ..... H01P 7/00

[52] U.S. Cl. ..... 333/219.2; 333/235; 335/222

[58] Field of Search ..... 333/202, 219, 333/219.2, 235; 335/212, 222, 298, 229, 234

[56] References Cited

U.S. PATENT DOCUMENTS

| | | | |
|---|---|---|---|
| 4,636,756 | 1/1987 | Ito et al. | 333/202 |
| 4,859,975 | 8/1989 | Uetsuhara | 335/234 X |
| 5,677,652 | 10/1997 | Parrott | 333/219.2 |

*Primary Examiner*—Seungsook Ham

*Attorney, Agent, or Firm*—Townsend and Townsend and Crew LLP; Kenneth R. Allen

[57] ABSTRACT

A ferrite resonating device operative for example as an oscillator or filter includes a mechanism for mechanically varying the position of a permanent magnet while maintaining a fixed main gap in which a ferrite resonating element is placed so that wide tuning can be achieved while maintaining electrical parameters substantially constant. In a specific embodiment, the ferrite resonating device includes a high-permeability shell, a permanent magnet disposed within the shell adjacent the main gap in which is mounted a ferrite resonating element, such as a YIG sphere, a field straightener formed of high-permeability material and disposed between the permanent magnet and the main gap for straightening magnetic field lines through the main gap, a secondary gap in the magnetic circuit, and an adjustment plug mounted to mechanically displace the permanent magnet relative to the field straightener for adjusting size of the secondary gap and optionally to shunt magnetic flux and thereby to control the frequency of resonance of the ferrite element over a broad range of frequencies.

8 Claims, 5 Drawing Sheets

MULTI-OCTAVE TUNABLE PERMANENT MAGNET FERRITE RESONATOR

BACKGROUND OF THE INVENTION

1. Field of Invention

This invention relates to ferrite devices such as microwave frequency oscillators and filters employing ferrite devices, and in particular Yttrium Iron Garnet (YIG) resonating elements, such as spheres or discs, which resonate in the presence of and under control of a magnetic field. More particularly, the invention relates to permanent magnet resonators, including YIG tuned oscillators, filters and the like, and mechanisms for controlling resonance over a wide frequency range.

It is desirable that tunable oscillators and bandpass filters have a broad tuning range. Heretofore, the tuning range of typical YIG devices has been limited by high power consumption of electromagnetics and the inability to maintain resonance and stability in the presence of a widely variable electric parameter and magnetic fields and the heat effects associated with high-energy dissipation needed to generate magnetic fields. A partial solution has been found in the use of a permanent magnet to bias the YIG resonator and one or more electromagnets to trim and variably tune the resonator.

2. Description of the Prior Art

FIG. 1 shows a conventional (prior art) permanent magnet biased electromagnetically tuned YIG oscillator 10 which includes a housing shell 12 of high permeability material wherein a permanent magnet 14 is mounted on a magnetic pole 16 and capped with a field straightener 18 of high permeability material forming a main (air) gap 20 in which is mounted one or more YIG spheres (and associated electronic connections) 22, and wherein an electromagnetic coil 24 surrounds the post 16 supporting the permanent magnet 14, as shown in FIG. 1 (prior art). The flux lines of the magnetic flux pattern across the main gap are generally parallel toward the center of the axis of the permanent magnet but that they diverge toward the edges, so YIG component placement is critical. Problems such as instability caused by temperature effects and the limited strength of prior permanent magnets have been mitigated by improved materials for the permanent magnet structures, so it has become more practical to use permanent magnets, rather than electromagnets, to bias the resonators, thereby replacing some of the magnetic field normally provided by the main coil 24.

Representative literature about the state of the art is as follows:

Mizunuma et al., "A 13-GHZ YIG-Film Tuned Oscillator for VSAT Applications," 1988 IEEE-MTT-S International Microwave Symposium Digest, pp. 1085–1088. This article describes the construction of one type of YIG resonator having a permanent magnet wherein the tuning range at 13 GHz is 500 MHz. It illustrates the difficultly in achieving multiple-octave tuning.

Ataiiyan et al., "Temperature Compensated Permanent Magnet YIG Tuned Oscillators," 1991 IEEE-MTT-S International Microwave Symposium Digest, pp. 965–968. This article describes permanent magnet biased YIG oscillators using newer materials.

SUMMARY OF THE INVENTION

According to the invention, a ferrite resonating device operative for example as an oscillator or filter includes a mechanism for mechanically varying the size of gaps in a magnetic circuit, and particularly, the position of a permanent bias magnet while maintaining a fixed main air gap in which a ferrite resonating element is placed in order to achieve a multi-octave tuning range while maintaining electrical parameters substantially constant. In a specific embodiment, the ferrite resonating device includes a housing formed of a high-permeability shell, a permanent magnet disposed within the shell adjacent the main gap, the permanent magnet being disposed to be adjustably shunted in the magnetic circuit, a field straightener formed of high-permeability material and disposed between the permanent magnet and the main gap for straightening magnetic field lines through the main gap, a nonmagnetic element supporting the field straightener, a secondary gap in the magnetic circuit at a variable separation between the field straightener and the main gap, and an adjustment plug mounted to mechanically displace elements-such as the permanent magnet relative to the field straightener for adjusting size of the secondary gap and thereby to mechanically control the frequency of resonance of a ferrite resonating element, such as a YIG sphere, mounted in the main gap, without affecting the size or physical characteristics of the main gap.

Various alternative embodiments are contemplated, including placement of the mechanical adjustment so that the permanent magnet is not displaced, or asymmetrical placement of the ferrite element in the main gap. The combined mechanisms yield a much greater tuning range than other tuned devices of comparable design, enabling tuning over multiple octaves of frequency. As much as three octaves of tunability has been achieved in practice.

The invention will be better understood by reference to the following detailed description in connection with the accompanying drawings.

DESCRIPTION OF SPECIFIC EMBODIMENTS

Figure 2:
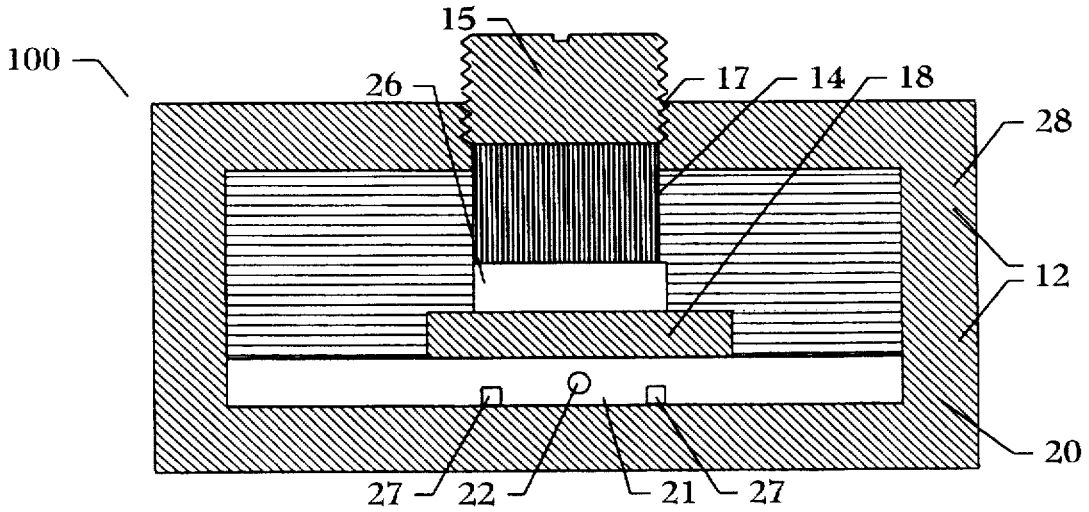
FIG. 2 is a side cross-sectional view of a ferrite resonating device according to a first embodiment of the invention.

Referring to FIG. 2, there is shown a side cross-sectional view of a ferrite resonating device in accordance with one embodiment of the invention. A permanent magnet biased electromagnetically tuned ferrite resonating structure 100, such as a YIG oscillator (PMYTO) or filter (PMYTF), includes a housing or shell 12 of high permeability material wherein a permanent magnet 14 is mounted on an adjustable-position pedestal or plug 15, which according to the invention, can be displaced along threads 17 from within the shell 12 to extend to a field straightener 18 of high permeability material within the shell 12. (Threads are not employed for example when the cylindrical plug is fixed in position.) The field straightener 18 is a disk of high-permeability material which acts somewhat like a lens to focus magnetic flux. It is mounted on a nonmagnetic element 28, such as an aluminum or CDA-792 spacer which fits within the shell 12, to establish a fixedly-spaced main (air) gap 20 in the space between field straightener 18 and an opposing inner wall 21 of the shell 12. A ferrite resonator 22 (a YIG sphere) and associated electronics (not shown) is mounted in the gap 20. The resonator 22 can be center mounted or it can be off-center or closer to one surface or the other, as determined by the design. An electromagnetic (FM fine tuning) coil 27 may surround the region of the main air gap 20 and is herein mounted to the wall 21 or side of field straightener 18.

According to another aspect of the invention, a variable secondary air gap 26 is established by the variable spacing between the face of the moveable magnetic circuit element, which in this case is permanent magnet 14, opposing the face of the field straightener 18. The provision of this design with the secondary air gap 26 in this position, and therefore in the magnetic path, results in important effects which contribute to the wide range of tunability of a device according to the invention.

1) A gradual variation of the strength of the magnetic field in the main air gap 20 is obtained by changing the length of the secondary air gap 26.

2) A gradual shunting of the permanent magnet 14 body in the high permeability housing 12 is obtained, which decreases the effective strength of the permanent magnet 14 and decreases the magnetic field, since the permanent magnet 14 is withdrawn into the shell 12 (which is part of the magnetic circuit) and thus shunting the path of the magnetic circuit. This mechanism alone is capable of reducing magnetic field, and therefore of changing resonance, more rapidly than the mechanism of varying the size (length) of the secondary air gap 26. These two mechanisms in combination provide a substantially increased mechanical tuning range compared to conventional mechanisms for mechanically-tuned circuits, thus enabling the ferrite device to be tuned over a multiple-octave range.

2) The placement of a field straightener between the permanent magnet 14 and the main gap 20 ensures the proper operation of the typical resonant ferrite device and associated active and passive components, due to relative orientation and the fixed spacing.

In addition, the spacing of the main gap 20 can be controlled as a function of the operating temperature, often a critical factor, since the field straightener 18 is mounted on a different nonmagnetic material element 28. This feature has important advantages for practical devices. It is possible to compensate for the variation of the strength of the permanent magnet over a range of temperatures by proper choice of the type of material for the element 28 so that the main gap 20 is reduced as the strength of the permanent magnet 14 decreases with increased temperature. While aluminum or CDA-792 are common metallic candidates, other materials of metal, ceramic, plastic or glass, having an appropriate coefficient of expansion, may be suitable.

Figure 1:
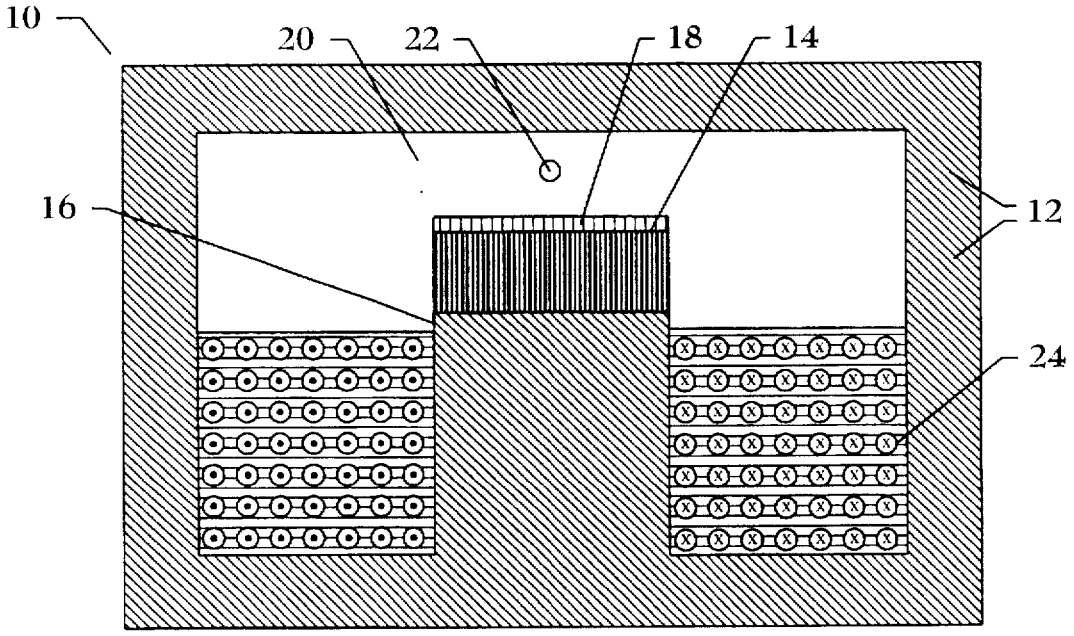
FIG. 1 is a side cross-sectional view of a ferrite resonating device of the prior art.

The FM coil 27 can be used to statically or dynamically precisely vary the tuned frequency of the ferrite device 22 over a limited range. The coil 27 is typically a solenoid of fine wire placed in close proximity to the ferrite element 22. Placement of the permanent magnet 14 outside of the mail coil 24 (FIG. 3) increases the efficiency of the main coil 14 by up to 300% in comparison to placement of the permanent magnet inside the main coil 24 as commonly practiced (FIG. 1). The added efficiency of the main coil 24 can be advantageous in a YIG device designed for low power consumption or a YIG device with one with a much greater tuning range capability.

Figure 6:
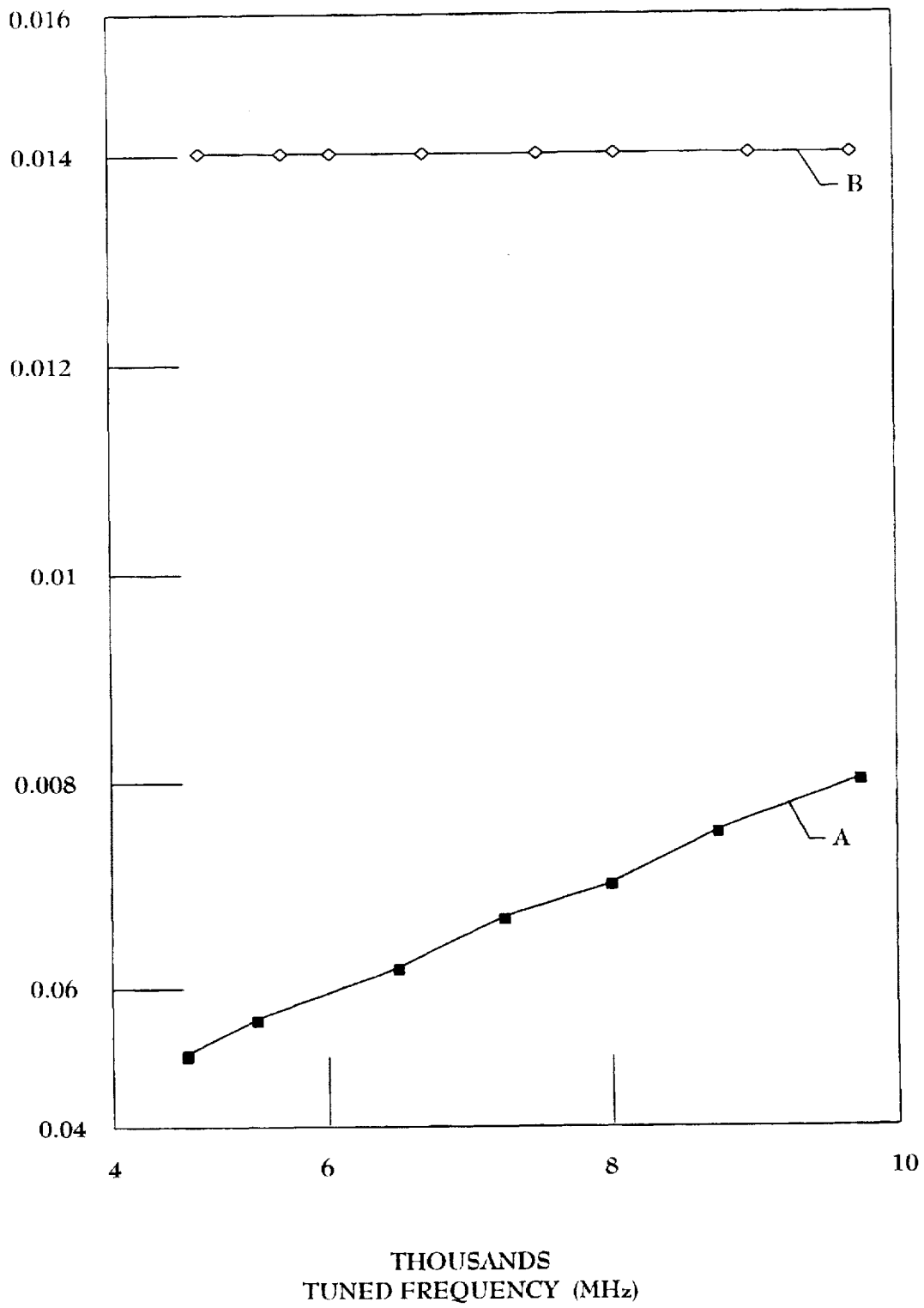
FIG. 6 is a graph illustrating tuned frequency vs. tuning sensitivity for a device of FIG. 3[B], when the main coil is used for electronic tuning as compared with the device of FIG. 1[A].

Still further, the placement of the permanent magnet 14 as shown in a position with respect to the actual magnetic path so that the introduction of a secondary air gap 26 does not influence efficiency of the coil 24 during mechanical tuning and has the effect of minimal variation in coil tuning sensitivity over the entire operating range of the ferrite device 22. FIG. 6 illustrates this linearity. Shown therein is tuned frequency vs. tuning sensitivity (in MHz/mA*Turns) for a device of FIG. 3 [B] as compared with the prior art device of FIG. 1[A]. Plot B has nearly flat tuning sensitivity, and, in the design which was tested, had substantially more tuning sensitivity than the increasing-sensitivity characteristic shown in Plot A.

Figure 3:
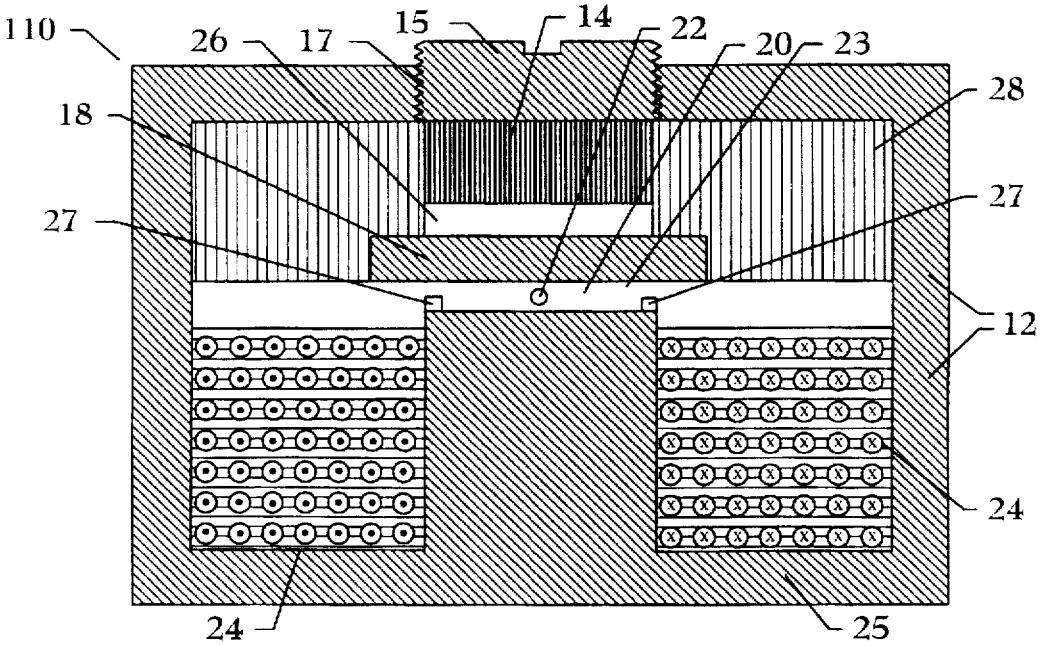
FIG. 3 is a side cross-sectional view of a ferrite resonating device according to a second embodiment of the invention.

Alternative embodiments have been suggested for this invention. Referring to FIG. 3, there is shown a resonating structure 110 which includes a housing shell 12 of high permeability material wherein the permanent magnet 14 is mounted on adjustable plug 15, which according to the invention, can be displaced along threads 17 from within the housing shell 12 to extend to a field straightener 18 of high permeability material within the housing shell 12. As in the previously-described embodiment, the field straightener 18 is mounted on nonmagnetic element 28 within shell 12 to establish a fixedly-spaced main (air) gap 20 with an opposing face 23 of a pedestal 25 magnetically coupled to the shell 12. The ferrite resonator 22 (YIG sphere) (and associated electronic connections, not shown) are in the main gap 20. An electromagnetic (FM fine tuning) coil 27 may surround the region of the main gap 20, placed on the pedestal 25. The pedestal 25 is also a high permeability core for an electromagnet coil 24. Variable secondary air gap 26 is established by the variable spacing between the face of the moveable permanent magnet 14 opposing the disk of the field straightener 18.

Figure 7:
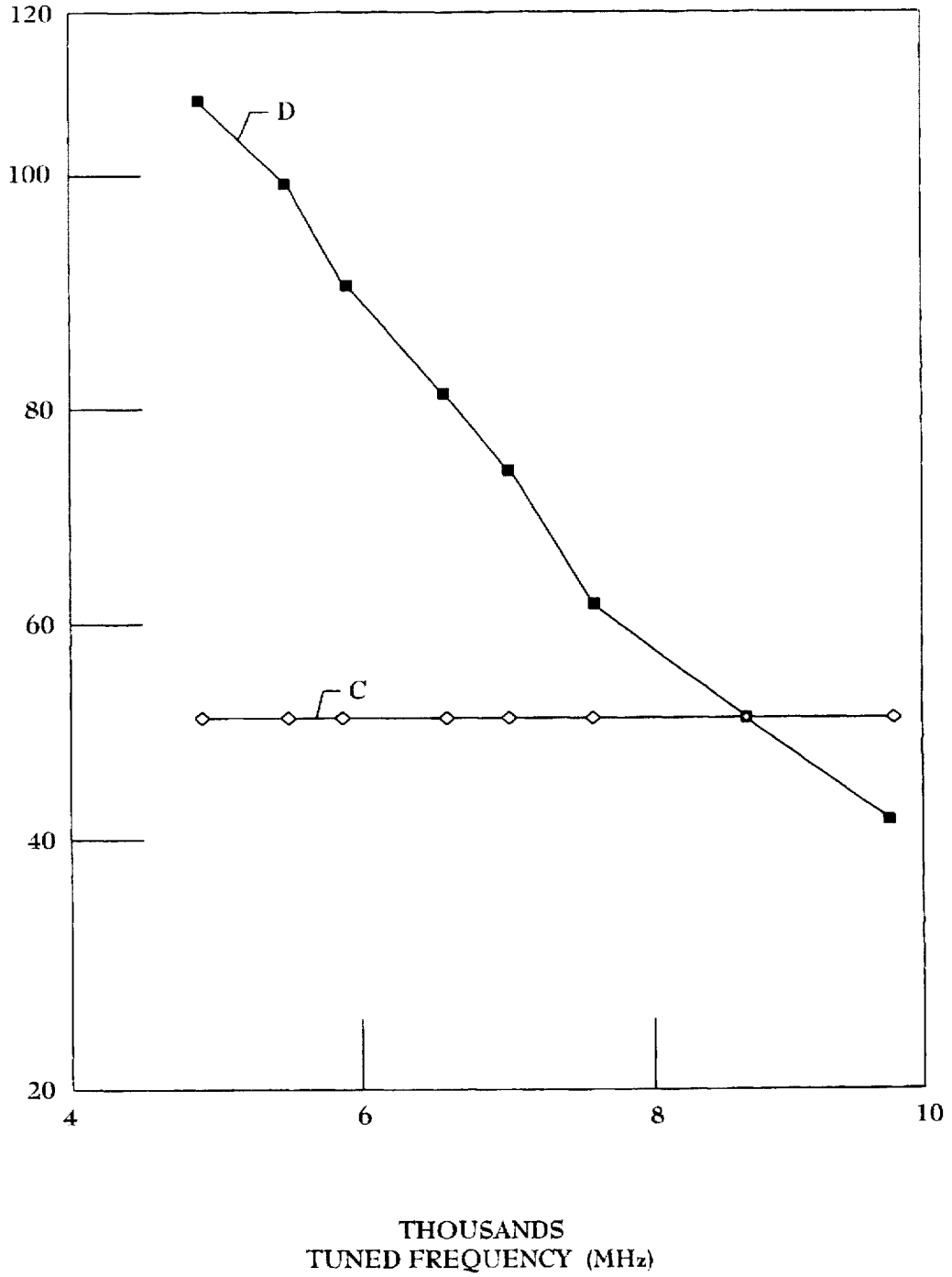
FIG. 7 is a further graph illustrating tuned frequency vs. main gap distance.

The electrical and magnetic performance of the ferrite and other active and passive components (not shown) placed in the main air gap 20 is not significantly degraded by the introduction of the variable secondary gap 26 and its variation in length and volume during mechanical tuning. The main gap 20 remains constant throughout the entire tuning range, as shown in plot C found on FIG. 7, in contrast to the physical height of a gap (Plot D) without a secondary gap, where the variation is as much as 300%.

Figure 4:
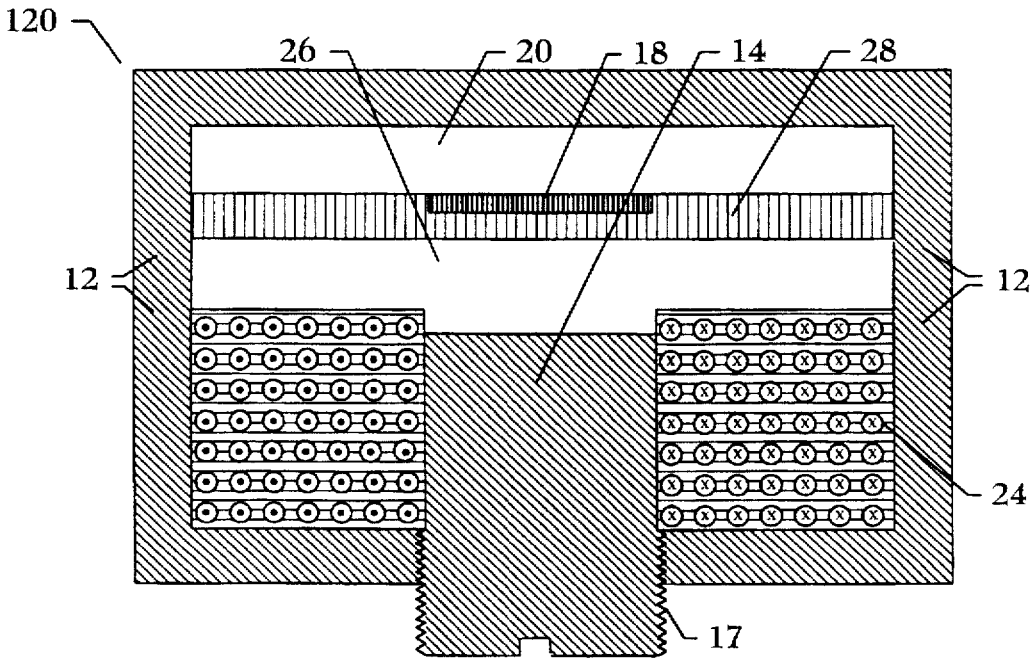
FIG. 4 is a side cross-sectional view of a ferrite resonating device according to a third embodiment of the invention.

FIG. 4 illustrates a still further embodiment 120 of the invention based on some of the inventive principles previously disclosed. Corresponding features are enumerated using common numerals. Unlike the previous embodiments, the permanent magnet 14 is mounted on an adjustable plug 15 which together form the core of main electromagnet coil 24, and the permanent magnet is translated entirely within the confines of the shell 12. There is no shunting effect in this embodiment. Sensitivity is decreased, allowing for a somewhat narrowed tuning range. However, the fixed spaced main gap 20 ensures proper operation of the electronic components placed in its region.

Figure 5:
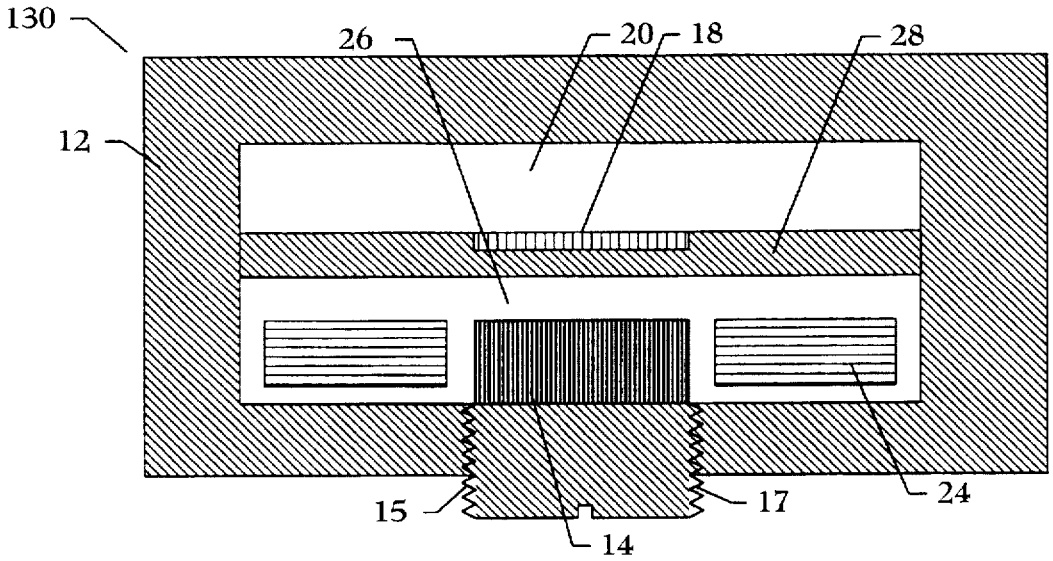
FIG. 5 is a side cross-sectional view of a ferrite resonating device according to a fourth embodiment of the invention.

The device 130 of FIG. 5, which is of the same topology but different dimensions from the device of FIG. 4, has multi-octave tuning capability, although the tuning range for the main coil, which is much shorter, will be lower. The permanent magnet 14 extends the full core length of the main coil 24 and can be withdrawn into the body of the shell 12. Hence it is able to benefit from the shunting effect.

The invention has now been explained with reference to specific embodiments. Other embodiments will be apparent to those of ordinary skill in the art from this description. It is therefore not intended that this invention be limited, except as indicated by the appended claims.

What is claimed is:

1. A multi-octave tunable permanent magnet-type ferrite resonating apparatus comprising:

a housing of a high-permeability material forming a shell;

a fixed-spaced main gap in a magnetic circuit within said shell, said main gap for placement of a ferrite resonator element responsive to magnetic fields;

a permanent magnet disposed at least partially inside of said shell in said magnetic circuit;

a field straightener element formed of high-permeability material, said field straightener element being disposed between said permanent magnet and said main gap for straightening magnetic field lines of magnetic flux through said main gap;

a nonmagnetic element supporting said field straightener element to hold said field straightener element in fixed position between a first side of said field straightener element and said main gap;

a secondary gap on a second side of said field straightener element opposing said first side, a first boundary of said secondary gap being defined by one face of said field straightener element; and an adjustment plug in said magnetic circuit mounted to said shell for adjusting size of said secondary gap.

2. The apparatus of claim 1 wherein said permanent magnet is mounted to said adjustment plug.

3. The apparatus according to claim 1 wherein said permanent magnet is mounted to said adjustment plug and is displaceable into a wall of said shell for shunting magnetic flux.

4. The apparatus according to claim 1 further including an FM tuning coil disposed to surround said ferrite element for fine tuning said ferrite element.

5. The apparatus according to claim 4 further including a pedestal of magnetic material in said shell and an electromagnet coil disposed in the magnetic circuit within said shell and encircling said pedestal, said pedestal forming a core to said electromagnet coil.

6. The apparatus according to claim 1, further including a pedestal of magnetic material in said shell and an electromagnet coil disposed in the magnetic circuit within said shell and encircling said pedestal, said pedestal forming a core to said electromagnet coil.

7. The apparatus according to claim 1 wherein said permanent magnet is mounted to said adjustment plug and is displaceable into a wall of said shell to shunt magnetic flux, and wherein said permanent magnet forms one face of said secondary gap.

8. A multi-octave tunable permanent magnet-type ferrite resonating apparatus comprising:

a housing of a high-permeability material forming a shell;

a main gap in a magnetic circuit within said shell, said main gap for placement of a ferrite resonator element responsive to magnetic fields;

a permanent magnet;

a field straightener element formed of high-permeability material, said field straightener element being disposed between said permanent magnet and said main gap for straightening magnetic field lines of magnetic flux through said main gap;

a nonmagnetic element supporting said field straightener element to hold said field straightener element in fixed position between a first side of said field straightener element and said main gap;

a secondary gap on a second side of said field straightener element opposing said first side, a first boundary of said secondary gap being defined by one face of said field straightener element; and an adjustment plug in said magnetic circuit mounted to said shell for adjusting size of said secondary gap, said permanent magnet being mounted to said adjustment plug and being displaceable into a wall of said shell to shunt magnetic flux.

* * * * *